United States Patent [19]

Scheineman

[11] 4,359,888

[45] Nov. 23, 1982

[54] DEVICE AND METHOD FOR STORING KEYS

[76] Inventor: Betty J. Scheineman, 7111 Richwood, Houston, Tex. 77087

[21] Appl. No.: 132,621

[22] Filed: Mar. 21, 1980

[51] Int. Cl.[3] ..... A47G 29/10

[52] U.S. Cl. ..... 70/457

[58] Field of Search ..... 70/456 R, 456 B, 457, 70/458, 459; 24/3 K; 150/40

[56] References Cited

U.S. PATENT DOCUMENTS

| | | | |
|---|---|---|---|
| 689,872 | 12/1901 | Griscom | 24/3 K |
| 792,677 | 6/1905 | Stowoll | 70/457 |
| 946,119 | 1/1910 | Field | 70/456 R |
| 1,048,011 | 12/1912 | Wachenheim | 24/3 K |
| 2,065,036 | 12/1936 | Townsend | 70/456 R |
| 2,405,369 | 8/1946 | Poulsen | 70/457 |
| 3,968,669 | 7/1976 | Coleman | 70/456 R |

*Primary Examiner*—Robert L. Wolfe

*Attorney, Agent, or Firm*—Ned L. Conley; Murray Robinson; William E. Shull

[57] ABSTRACT

A device and method for storing a set of keys in the compartment of a purse are disclosed. The device includes a flexible member, a key retaining device attached to one end of the flexible member and an end piece attached to the other end of the flexible member. The method of the invention includes attaching one or more keys to the key retaining device, lowering the key retaining device into the purse compartment and draping the flexible member over the opening of the purse compartment such that the end piece hangs freely outside the purse compartment.

11 Claims, 3 Drawing Figures

DEVICE AND METHOD FOR STORING KEYS

BACKGROUND OF THE INVENTION

The present invention relates to devices and methods for carrying keys and more particularly to a device that includes a long, flexible member with a key ring on one end and an end piece on the other end and a method for using the device in association with a purse wherein the key ring is disposed inside a compartment of the purse, the flexible member extends from the key ring to the outside of the purse and the end piece hangs substantially free outside the purse.

Various devices have been used for carrying a set of keys. Such devices have included simple rings and key cases, both of various configurations. The ring-type devices have sometimes included any of a variety of decorative pieces, such as an initialed piece of acrylic, or useful implements, such as nail clippers, attached to the ring either directly or by a short chain-like member. In another ring-type device, the ring is attached to a relatively long chain-like member retractably secured in a belt-mountable housing. In this latter device, the keys hang below the user's belt when not in use. When the user wishes to use one of the keys mounted on the ring, the user pulls the ring thereby pulling the chain from the housing. When the use is completed, the user releases the ring and the chain restracts into the housing whereby the keys return to their position below the user's belt.

Because of the nature of the women's clothing and the dictates of fashion in general, women ordinarily do not carry keys on their person, either on a belt or in a pocket, but, instead carry a key ring or key case with a set of keys attached in a purse compartment. Often, these compartments are large and are used to carry numerous other items. As a result, when it comes time to use their keys, women are commonly subjected to a long, frustrating and generally inconvenient search for their keys.

In an effort to overcome this problem, various devices for securing keys in a convenient location in a purse compartment have been developed. Such devices are disclosed in U.S. Pat. No. 2,071,757, issued to Matthews on Feb. 23, 1937; U.S. Pat. No. 3,326,258, issued to Stucker on June 20, 1967; and U.S. Pat. No. 3,682,216, issued to Nelson on Aug. 8, 1972. All of such devices include a key holder substantially permanently affixed to the inside of the purse compartment. As a result, a user of such devices must either purchase a purse specially equipped with the key holder or must face the added expenses and inconvenience of mounting the device in the purse compartment. Furthermore, such devices are not interchangeable from one purse to another, thus either limiting the user to a single purse or burdening the user with the expenses and inconvenience of mounting a key holder in each of her purses. In addition, the mounting of such devices in a purse compartment may tend to damage the purse. Some purses may not even be susceptible to the mounting of such devices. Also, although such devices may tend to reduce the problems associated with the recovery of keys from a purse compartment, some of such devices, e.g., the Stucker and Nelson devices, require that the keys be carefully attached to the key holder after each use.

SUMMARY OF THE INVENTION

The present invention is a key carrying device and method wherein a set of keys can be easily and quickly recovered from and returned to a purse compartment. The inventive device and method can be used with essentially any purse and require no attachment to the purse.

The device of the invention includes (i) a key retainer to which a set of keys can be attached, (ii) an end piece and (iii) a long, flexible member having one end attached to the key retainer and the other end attached to the end piece. The end piece may have a ring-like configuration such that it can be readily and removably slipped over the end of a column-mounted gear-shift lever of an automobile. The method of the invention includes attaching one or more keys to the key retainer, placing the keys in a purse compartment while holding the end piece and draping the flexible member around the mouth of the purse compartment such that the end piece hangs freely outside the purse.

BRIEF DESCRIPTION OF THE DRAWINGS

For a further understanding of the nature and objects of the present invention, reference should be made to the following detailed description, taken in conjunction with the accompanying drawings, in which like parts are given like reference numerals and wherein.

DETAILED DESCRIPTION OF THE PREFERRED EMBODIMENT

Figure 1:
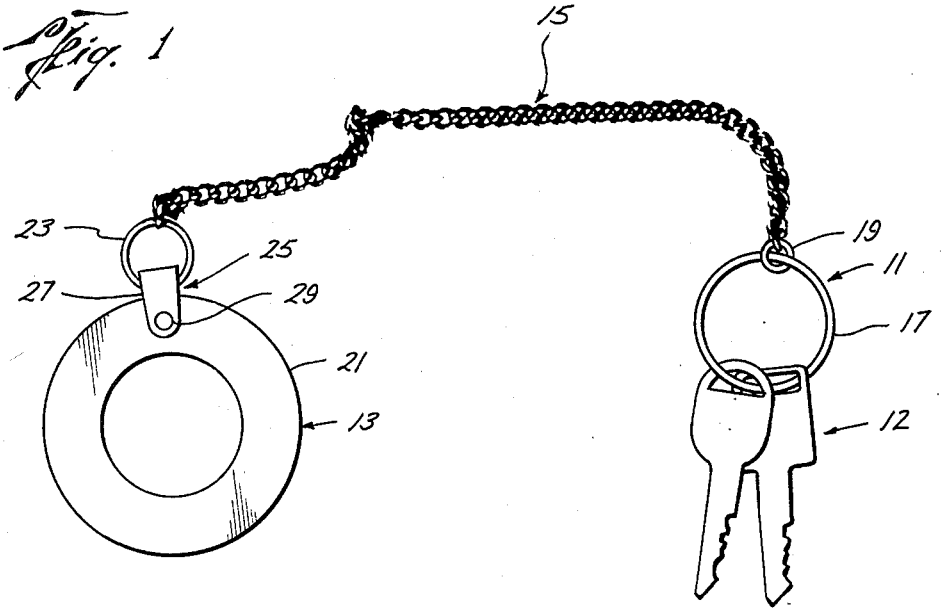
FIG. 1 is a pictorial view of the preferred embodiment of the device of the invention.

Referring to FIG. 1, the present invention includes key retaining device 11 to which one or more keys 12 can be attached either directly or indirectly, end piece 13 and flexible member 15 attached at one end to key retaining device 11 and at the other end to end piece 13.

Key retaining device 11 may be any of a variety of devices to which keys may be attached. In the preferred embodiment, device 11 includes split link 17 and continuous ring 19. Split links are metal links consisting of two turns of a helix pressed flat together and are well-known in the art pertaining to key holding devices. As shown in FIG. 1, a plurality of keys 12 are retained directly by split link 17. Split link 17 is, in turn, linked to continuous ring 19.

Flexible member 15 may be any of a wide variety of flexible linking type devices such as a chain, cord or cable or a strip of nylon or plastic. The flexibility and length of member 15 should be such that when key retaining device 11 rests in a purse compartment, member 15 will extend out of the compartment and hang freely outside of the purse, preferably about two to three inches. In the preferred embodiment, member is a metallic chain between seven and sixteen inches long. Continuous ring 19 is permanently linked to one of the end links of the chain.

End piece 13 may be any of a variety of devices that can be attached to the end of flexible member 15 opposite key retaining device 11. It is desirable that end piece 13 be both attractive and capable of being easily grasped. In the preferred embodiment, end piece 13 includes a flat ring 21 that can be removably slipped over the end of a column-mounted gear shift lever of an automobile. Such a ring may have an inside diameter of between $1\frac{1}{4}$ inch and 2 inches. The ring may be made of any of a variety of materials including either rigid or flexible plastic. In the preferred embodiment, ring 21 has a thickness of approximately $\frac{1}{8}$ inch and is made of a durable, flexible, transparent plastic that can be tinted with any of a variety of colors and engraved with lettering and/or assorted designs. Further, in the preferred embodiment, end piece 13 further includes continuous ring 23 and plastic loop 25 by means of which ring 21 is attached to member 15. Loop 25 includes clevislike strap portion 27 extending to either side of ring 21 and pin 20 extending through ring 21 and secured at either end to strap portion 27.

Figure 2:
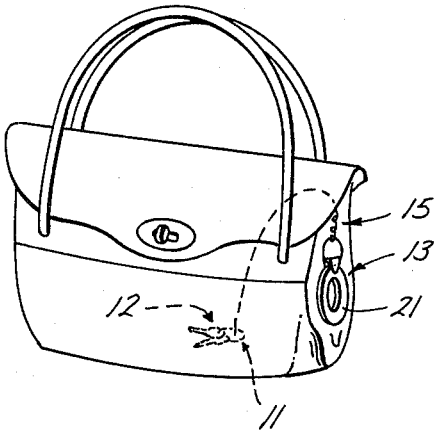
FIG. 2 is a pictorial view of the preferred embodiment of the device of the invention showing its use in the preferred format of the method of the invention.

The method of the invention is a method for using the device of the invention for carrying one or more keys in a compartment of a purse. In accordance with such method, one or more keys is attached to retaining device 11. The actual procedure of attachment will vary depending on the configuration of retaining device 11 and will be readily apparent to the user of the device. End piece 13 or flexible member 15 is then grasped and retaining device 11, with keys 21 attached, is lowered into the purse compartment. Flexible member 15 is then draped over the mouth or opening of the purse compartment such that end piece 13 hangs freely outside the purse compartment. Preferably, end piece 13 is disposed to one end of the purse as shown in FIG. 2 so that end piece 13 appears as a decorative part of the purse.

Once stored in a purse compartment in accordance with the method of the invention, keys can be easily retrieved from such compartment merely by opening the compartment and pulling end piece 13 upwardly away from such compartment. Such a retrieval procedure can be readily accomplished by a user even though the user is burdened with packages or some other load such as a baby or a small child.

The ease with which a set of keys can be retrieved from a purse compartment when stored in accordance with the method of the invention together with the nature of the device of the invention makes the device of the invention useful as a protective weapon for women. Should a user be attacked or be suspicious of a potential attack, the keys can be quickly removed from the purse compartment as described above. The length of the flexible member and the weight of the keys will cause the keys to strike an attacker with substantial repelling force when the user swings the device while holding the end piece.

Figure 3:
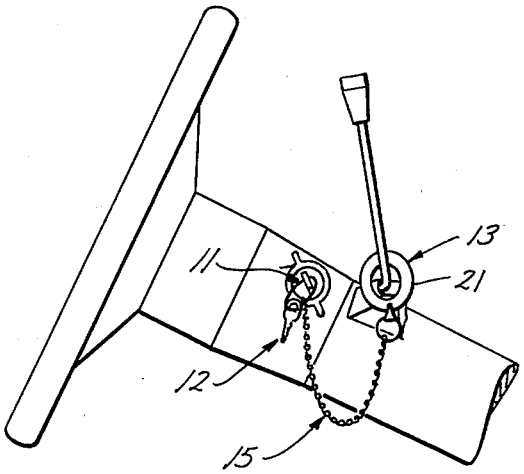
FIG. 3 is a pictorial view of the preferred embodiment of the device of the invention showing its placement in an automobile while one of the keys held by the device is in the ignition.

Furthermore, several other advantages result from the nature of the preferred embodiment of the device of the invention. For example, referring to FIG. 3, when a key held by the device of the preferred embodiment of the invention is to be inserted into ignition 29 of an automobile, ring 21 of end piece 13 can be slipped over the end of the gear shift lever 31 or of some other lever or knob, or other control device, near the ignition. In this way, member 15 and end piece 13 do not tend to obstruct operation of the automobile or otherwise cause discomfort to the operator. Also, flexile member 15 can be pulled through ring 17 and the device can be worn as a bracelet with the keys handing therefrom. Furthermore, ring 21, if made of a soft, flexible plastic can be used as a child's teething ring.

Although the embodiment of the device described in detail herein has been found to be most satisfactory and preferred, different applications and many variations in the elements and their structure are possible. Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A device that can be used for carrying keys in the compartment of a purse, such compartment having a bottom at one end, surrounding sides and an opening at the other end, comprising:

a key retaining device to which such keys can be attached;

an end piece; and a long, flexible member connected at one end to said key retaining device and at the other end to said end piece, the length and flexibility of said member being such that when said key retaining device carrying such keys rests on the bottom of such compartment, a portion of said member including said other end of said member can extend over the sides of and outside such compartment through the opening therein with said end piece hanging freely outside such compartment, and the combined weight of such end piece and such portion of said member being less than that required to cause said key retaining device to be forced by gravity off of such bottom of such compartment.

2. The device of claim 1 wherein said member is a chain.

3. The device of claim 1 or 2 wherein said member is at least seven inches long.

4. The device of claim 1 wherein said end piece is a flat ring, that is, having an inner diameter substantially smaller than its outer diameter.

5. The device of claim 4 wherein the inside diameter of said flat ring is at least large enough for a finger to pass through said ring.

6. The device of claim 1 or 4 wherein said end piece is made of a soft, durable, flexible plastic material.

7. A method for carrying keys in a purse compartment having a bottom at one end, surrounding sides and an opening at the other end using a device that includes a flexible member, a key retaining device at one end of the flexible member and an end piece at the other end of the flexible member, the method comprising the steps of:

attaching a key to the key retaining device;

lowering the key retaining device with the key attached into the purse compartment such that the key retaining device carrying such key rests on the bottom of such purse compartment; and draping the flexible member over the sides of and outside such purse compartment through such opening such that the end piece hangs freely outside the purse compartment.

8. The method of claim 7 wherein the step of lowering the key retaining device into the purse compartment includes grasping the end piece.

9. The method of claim 7 wherein the steps of lowering the key retaining device into the purse compartment includes grasping the flexible member.

10. A device that can be used for carrying keys in the bottom of a compartment of a purse, comprising:

a split link to which keys can be attached;

a flat ring made of a soft, durable, flexible plastic material and having an inner diameter substantially smaller than its outer diameter, such inner diameter being at least large enough for a human finger to pass through said ring;

a plastic loop having a clevislike strap portion attached to said flat ring by a pin extending through said flat ring and secured at both ends to said strap portion of said plastic loop;

a continuous ring attached to said flat ring by said plastic loop; and a long, flexible member connected at one end to said split link and at the other end to said continuous ring, the length and flexibility of said flexible member being such that when said split link carrying such keys rests on the bottom of such compartment, said flexible member can extend outside of such compartment with said flat ring hanging freely outside of such compartment.

11. The device of claim 10, wherein said flexible member is a chain of between approximately 7 and 16 inches in length and said flat ring has an inside diameter in the range of approximately $1\frac{1}{2}$ inches to approximately 2 inches and a thickness of approximately $\frac{1}{8}$ inch.

* * * * *